US010820623B2

(12) United States Patent
Grant

(10) Patent No.: US 10,820,623 B2
(45) Date of Patent: Nov. 3, 2020

(54) METHOD AND APPARATUS FOR MANUFACTURING AEROSOL-GENERATING SEMI-FINISHED PRODUCTS

(71) Applicant: PHILIP MORRIS PRODUCTS S.A., Neuchatel (CH)

(72) Inventor: Christopher John Grant, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 507 days.

(21) Appl. No.: 15/503,801

(22) PCT Filed: Sep. 17, 2015

(86) PCT No.: PCT/EP2015/071368
§ 371 (c)(1),
(2) Date: Feb. 14, 2017

(87) PCT Pub. No.: WO2016/042100
PCT Pub. Date: Mar. 24, 2016

(65) Prior Publication Data

US 2017/0273352 A1 Sep. 28, 2017

(30) Foreign Application Priority Data

Sep. 19, 2014 (EP) ..... 14185597

(51) Int. Cl.
*A24C 5/47* (2006.01)
*A24C 5/28* (2006.01)
*A24F 47/00* (2020.01)

(52) U.S. Cl.
CPC ..... *A24C 5/471* (2013.01); *A24C 5/28* (2013.01); *A24C 5/475* (2013.01); *A24F 47/006* (2013.01)

(58) Field of Classification Search
None
See application file for complete search history.

(56) References Cited

U.S. PATENT DOCUMENTS 3,176,560 A * 4/1965 Bardenhagen ..... A24C 5/28 83/174
3,372,702 A 3/1968 Bohn
(Continued)

FOREIGN PATENT DOCUMENTS

CN 203399705 1/2014
CN 103929989 7/2014
(Continued)

OTHER PUBLICATIONS

PCT Search Report and Written Opinion for PCT/EP2015/071368 dated Dec. 1, 2015 (15 pages).
(Continued)

*Primary Examiner* — Michael H. Wilson
*Assistant Examiner* — Katherine A Will
(74) *Attorney, Agent, or Firm* — Mueting Raasch Group

(57) ABSTRACT

The method and apparatus for manufacturing aerosol-generating semi-finished products comprise the steps of combining substantially cylindrical segments along a longitudinal first motion path. The following steps are performed along the first motion path: feeding a stream of at least three different segments along the first motion path, thereby arranging the at least three segments in alternating order, wrapping the stream of at least three segments in a sheet material to form an endless rod of segments, and cutting the endless rod of segments, thereby separating the endless rod of segments into wrapped segment rods. The method also comprises the step of processing wrapped segment rods along a second motion path, wherein the following step is performed along the second motion path: receiving the wrapped segment rods in flutes of a fluted receiving drum,
(Continued)

wherein an end of the first motion path is aligned with a longitudinal axis of the flutes of the fluted receiving drum.

17 Claims, 2 Drawing Sheets

(56) References Cited

U.S. PATENT DOCUMENTS

| | | | | |
|---|---|---|---|---|
| 3,825,105 | A | 7/1974 | Cristiani | |
| 4,103,593 | A | 8/1978 | Brown, Jr. | |
| 4,723,559 | A | 2/1988 | Labbe | |
| 5,666,976 | A * | 9/1997 | Adams | A24F 47/008 131/94 |
| 5,948,851 | A | 11/1999 | Irikura | |
| 8,109,277 | B2 | 2/2012 | Li | |
| 8,113,217 | B2 | 2/2012 | Grzonka | |
| 2006/0201523 | A1 | 9/2006 | Schlisio | |
| 2012/0067360 | A1 | 3/2012 | Conner | |
| 2013/0133675 | A1 * | 5/2013 | Shinozaki | A24F 47/006 131/329 |

FOREIGN PATENT DOCUMENTS

| | | |
|---|---|---|
| EA | 200970846 | 2/2010 |
| EP | 2625975 | 4/1988 |
| EP | 1767107 | 3/2007 |
| EP | 1763306 | 11/2009 |
| EP | 2962108 | 12/2015 |
| RU | 2314735 | 1/2008 |
| WO | WO 2006/000918 | 1/2006 |
| WO | WO 2013/043299 | 3/2013 |
| WO | WO 2013/120565 | 8/2013 |
| WO | WO 2013/164124 | 11/2013 |
| WO | WO 2013/190036 | 12/2013 |
| WO | WO 2014/023555 | 2/2014 |
| WO | WO 2014/064655 | 5/2014 |
| WO | WO 2014/072953 | 5/2014 |
| WO | WO 2014/136225 | 9/2014 |

OTHER PUBLICATIONS

PCT International Preliminary Report on Patentability for PCT/EP2015/071368 dated Jan. 4, 2017 (23 pages).
Communication of Notice of Opposition for European Application No. 15766464.0 dated Jul. 31, 2020 (28 pages).

* cited by examiner

METHOD AND APPARATUS FOR MANUFACTURING AEROSOL-GENERATING SEMI-FINISHED PRODUCTS

This application is a U.S. National Stage Application of International Application No. PCT/EP2015/071368, filed Sep. 17, 2015, which was published in English on Mar. 24, 2016 as International Publication No. WO 2016/042100 A1. International Application No. PCT/EP2015/071368 claims priority to European Application No. 14185597.3 filed Sep. 19, 2014.

The invention relates to a method and apparatus for manufacturing aerosol-generating substantially cylindrical semi-finished products, especially aerosol-generating double products.

Aerosol-generating articles are assembled from several different segments. For manufacturing aerosol-generating articles, segments are typically combined to form an endless rod of segments. The endless rod is subsequently cut and the cut rod portions are combined with further segments, such as mouthpieces. For example, in WO2013/164124 a repetitive series of three segments is arranged in an endless rod. The endless rod is then cut into individual rod-shaped articles. The method disclosed in WO2013/164124 requires turning of every other rod-shaped article in order for the rod-shaped article to be arranged with a second double-length rod-shaped article. Such a turning step requires space in high speed machinery and bears the risk of misplacement of or damaging the rod-shaped article. In addition, the method involves several different motion paths, wherein a moving direction of an article is changed between subsequent motion paths.

Thus, there is a need for a method and apparatus for manufacturing aerosol-generating semi-finished products at high production speed.

According to a first aspect of the present invention, there is provided a method for manufacturing aerosol-generating semi-finished products, wherein the semi-finished products are substantially cylindrical. The method comprises the step of combining substantially cylindrical segments having a longitudinal axis in an end-to-end relationship along a longitudinal first motion path. Thereby, the following steps are preformed along the first motion path: feeding a stream of at least three different segments along the first motion path, thereby arranging the at least three different segments in end-to-end relationship and in alternating order; wrapping the stream of at least three different segments in a sheet material to form an endless rod of segments; and cutting the endless rod of segments, thereby separating the endless rod of segments into wrapped segment rods. The method also comprises the step of processing wrapped segment rods along a second motion path. Thereby, the following step is performed along the second motion path: receiving the wrapped segment rods from the combiner in flutes of a fluted receiving drum, wherein an end of the first motion path is aligned with a longitudinal axis of the flutes of the fluted receiving drum. The longitudinal axis of segments in the endless rod of segments is arranged parallel to a moving direction of the first motion path and the longitudinal axis of segments in the wrapped segment rods are arranged perpendicular to a moving direction of the second motion path.

Preferably, semi-finished products are double products, that is, products having double the length of a single product. However, semi-finished products as used herein may also be wrapped segment rods that are produced by cutting the endless rod of segments as well as any intermediate products that are manufactured after the cutting of the endless rod of segments and the manufacture of the double product.

In some embodiments of the method according to the invention, the method further comprises performing the following further steps along the second motion path: cutting the wrapped segment rod, thereby dividing the wrapped segment rod in two parts; separating the two parts of the cut wrapped segment rod along the longitudinal axis of segments of the cut wrapped segment rods; feeding and inserting an additional segment in between the two parts of the cut wrapped segment rod; and forming a double product by combining the two parts of the cut wrapped segment rod and the inserted additional segment by wrapping the two parts of the cut wrapped segment rod and the inserted additional segment in a tipping material.

By directly superposing an end of a longitudinal, preferably substantially straight, first motion path and a beginning of a second motion path, semi-finished and double products may be manufactured in one continuous process. Where the first motion path is arranged in a combiner and the second motion path is arranged in a tipping device, combiner and tipping device interface each other. Preferably, the combiner and the tipping device are arranged transvers to each other such that the second motion path in the tipping device is arranged perpendicular to the motion path in the combiner. By this, the axis of the segments in the endless rod of segments, as well as in the semi-finished products and in the final product are always parallel to each other. No turning of the segments is required. In the tipping device, a separation motion may be perpendicular to the moving direction of the cut wrapped segment rod. During this separation motion, preferably, the cut wrapped segment rod is arranged in a flute of a respective separation drum. Next to this separation motion, there is only one motion path in the tipping device, where the segments are transported along. There is also no transfer required for semi-finished products or parts thereof in the tipping device. Thus, risks to lose or damage objects upon handling are significantly reduced in the tipping device. Equipment for turning objects are not required and manufacturing time or space for such process steps may be saved. The segments and any semi-finished products formed therewith maintain their alignment from the moment the segments are combined until they reach the end of the tipping device. The segments perform pure translational movements and no rotation.

In addition, in the combiner and in the tipping device including the transfer from the combiner to the tipping device, the semi-finished products are processed according to an individual product flow. In an individual product flow, control over an individual product is given at any stage in a manufacturing and processing line. For example, the position and alignment of the product is known at any time. This allows, for example, to provide a single discharge device at one location in the processing line only. Detection means to detect objects not fulfilling specification requirements may, for example, be arranged along the entire processing line. Due to the individual product flow, the objects to be disposed of may be virtually marked and disposed of further downstream by the discharge device.

As used herein, the terms 'upstream' and 'downstream' when used to describe the relative positions of elements, or portions of elements, of the combiner or tipping device or other apparatus refer to the direction in which the plurality of semi-finished products or single products moves during the manufacturing or transporting process. That is, the semi-finished products or single products move in a downstream direction from an upstream end to a downstream end.

Such a control over or localization of each product is, for example, not available in a product mass flow. In a mass flow the products are transported along a general moving direction. Thus an exact position of the individual products in the mass flow is not known. Product mass flows are, for example, known in storage or buffering systems or supply reservoirs.

The specific arrangement of the segments in the endless rod of segments in alternating manner, that is, in serial and inverse serial manner, allows the manufacturing of double products in a continuous manufacturing process without requiring a turning step, neither of a segment, a wrapped segment rods, a double product nor any other semi-finished product manufactured in the apparatus according to the invention.

Even final products may be manufactured in the continuous process without the requirement of a turning step. To manufacture final products, the method further comprises the step of cutting the additional segment arranged in the double product, thereby dividing the additional segment and forming single products. Therein, the double-length segment is cut into two single-length segments to form two final products from the double product.

The term "alternating order" is understood to comprise a serial and inverse serial order of segments: series of segments and inverse series of segments are arranged alternatingly. The segments will be arranged in alternating ascending and descending order, wherein, preferably, different segments only are arranged next to each other. For example, three different segments A, B and C are arranged in ascending and descending order such as to form, for example, ABCBABCBABCB . . . . In general, the stream of segments may have a sequence of a period of at least one more than the amount of different segments in the stream. For example, if the stream of segments is made by combining three different segments, the period may be a sequence of four different segments, for example ABCB-ABCB-ABCB . . . . For example, if the stream of segments is made by combining four segments, the period may be a sequence of five segments, for example ABCDCB-ABCDCB-ABCDB . . . . In these examples, the serie of segments is ABC(D) and the inverse serie is (D)CBA, wherein the last segment of a serie is at the same time the first segment of the inverse serie and vice versa. In alternative embodiments a last segment of a serie and a first segment of an inverse serie may be an identical segment but not the same segment, for example ABCCBAABCCBA . . . or ABCCBABCCBA . . . . In these embodiments an endless rod formed by wrapping the stream of segments may be cut in between identical segments to form wrapped segment rods.

The term "substantially straight first motion path" us used herein to describe a straight motion path including small bends or sloped in the path. However, the small bends and slopes do preferably not exceed a 20 percent deviation from the exactly straight path.

The term "substantially cylindrical" is used herein to describe semi-finished products and segments having a substantially constant cross section along their length and includes, for example, cylinders having a circular or oval cross section. The semi-finished products and segments may for example be rod-shaped having a circular or oval cross section.

The term "segment" is used to refer to an element of the stream of segments with defined boundaries. The individual segments may have a longitudinal extension, which is larger than a radial extension. Preferably, the segments have a substantially circular cross section. Preferably, the segments of the stream of segments have at least one of a different flexibility, a different hardness, a different compressibility, a different weight, a different shape, a different length, a different construction, different material properties, a different resistance to draw or different filtration properties. The segments of the stream of segments may for example be cuttable or uncuttable. Preferably, a non-uniform characteristic of the stream of segments is found along a length of the stream of segments or along a length of one or several segments. For example a non-uniform firmness may be present in a filter element made of filter tow containing a capsule. Segments may for example have a concentric or non-concentric arrangement. Preferably, segments of an assembly of segments are made of or contain different materials such as for example carbonaceous or ceramic material, cardboard material, paper material, metals, filter tow, polylactic acid, tobacco or tobacco containing material, plant leaf material or combinations thereof. A segment may have a length, which is equal to or is a multiple of the length of a plug. Wherein, a 'plug' is the single-length segment as in the final product.

According to an aspect of the method according to the invention, cutting the endless rod of segments comprises cutting a first one of the at least three different segments. According to another aspect of the method according to the invention, cutting the wrapped segment rod comprises cutting a second one of the at least three different segments.

The endless rod in the combiner is cut into discreet rod elements that may individually be transferred into the flutes of the fluted receiving drum of the tipping device. This may be done by cutting the rod between two segments or by cutting the rod at a predetermined position along a segment.

Preferably, the endless rod in the combiner is divided by cutting a segment. By this, segments for more than one, preferably two, wrapped segment rod or future single products may be produced by one final cutting step. Yet further, with one feeding step, that is, with the feeding of one single segment, material for several plugs may be provided to the stream of segments. In addition, the cutting of a segment allows for larger manufacturing tolerances. This is favorable where an endless rod needs to be cut. Basically no tolerance is available when cutting between segments. In addition, when cutting has to be performed between two segments, great care may have to be taken in order not to damage the segments, for example rigid or brittle segments.

This also applies for the cutting of the second one of the at least three different segments in the tipping device. Also for this cutting step only one single segment had to be fed onto the first motion path. The initially one segment contributes to at least two future products.

In aerosol-generating products, generally segments of different compressibility are used. A stream of segment may comprise rigid segments that may be arranged next to ductile segments. Some segments should not be compressed or pushed hard in order not to be scratched, deformed or otherwise inadvertently be damaged. Such segments may for example be rigid segments or plastically deformable segments. Other segments may need to be pushed or compressed in order to stay in position in the stream of segments.

Preferably, at least one segment is a rigid segment. Preferably, at least one segment of the at least three different segments is a rigid segment. A rigid segment preferably has a compressibility higher than about 10 Newton per 1.5 mm and preferably, less than about 100 Newton per 1.5 mm. Preferably, the compressibility of at least one of the segments is between about 20 Newton per 1.5 mm and about 100 Newton per 1.5 mm and more preferably between about 50 Newton per 1.5 mm and about 100 Newton per 1.5 mm.

In some embodiments the rigid segment is brittle and will not compress at all, for example a ceramic or carbonaceous segment, but the segment will instead shatter. In such an embodiment the compressibility is substantially infinite as the segment will rather break than compress.

A rigid segment is basically non-compressible or non-flexible upon compression in comparison to at least partly flexible segments such as for example segments containing aerosol-generating substrate or filter elements made of filter tow.

A rigid segment may for example be a heat source, for example a combustible heat source. The heat source may be a carbonaceous or carbon-based heat source, that is, a carbon containing heat source or a heat source comprised primarily of carbon, for example having a carbon content of at least 50 percent by dry weight. The length of a heat source segment may be about 6 mm to about 15 mm, preferably 10 mm to about 12 mm. An external diameter of a heat source segment may be between about 5 mm and about 12 mm, for example 7 mm.

A rigid segment may for example be a support element, for example in the form of a hollow tube. The tube may comprise or be made of cellulose acetate or cardboard or both. The length of a support element may be about 5 mm to about 12 mm, for example 8 mm. An external diameter of a support element may be between about 5 mm and about 12 mm, for example between about 5 mm and about 10 mm or between about 6 mm and about 8 mm, for example 7 mm.

Preferably, at least one segment is a compressible segment. Preferably, at least one segment of the stream of segments is a compressible segment. A compressible segment may for example be an aerosol-cooling segment or an aerosol-forming substrate.

In some embodiments the compressibility of a segment is not monotonous, for example in a filter segment that comprises a capsule that is dispersed in the filtration material. In such a case, the segment is at first easily compressible as long as the filtration material is compressed, for example acetate tow. Then, the compressibility is reduced when the capsule is reached. Then, after the capsule breaks, the compressibility is increased again.

Depending on the manufacturing method of the aerosol-generating product, segments to form the endless rod of segments may be comprised in the stream of segments in their final (single) length or may be comprised in the stream of segments having a length which is a multiple of, preferably twice, the length of the single segment in the single product. Preferably, compressible segments have a multiple length when in the stream of segments and are later cut to the single length as used in the final product. Preferably, aerosol-cooling segments or aerosol-forming substrates or both kind of segments are comprised in the stream of segments in a length being a multiple of the single length, preferably multiple-length segments or double-length segments.

An aerosol-forming substrate is a substrate capable of releasing volatile compounds that can form an aerosol. Volatile compounds may be released by heating or combusting the aerosol-forming substrate. As an alternative to heating or combustion, in some cases volatile compounds may be released by a chemical reaction or by a mechanical stimulus, such as ultrasound. An aerosol-forming substrate may be solid or liquid or comprise both solid and liquid components. An aerosol-forming substrate may be adsorbed, coated, impregnated or otherwise loaded onto a carrier or support. An aerosol-forming substrate may comprise plant-based material, for example a homogenised plant-based material. The plant-based material may comprise tobacco, for example homogenised tobacco material. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise at least one aerosol-former. The aerosol-forming substrate may comprise nicotine and other additives and ingredients, such as flavourants. Preferably, the aerosol-forming substrate is a tobacco sheet such as a cast leaf tobacco. Cast leaf tobacco is a form of reconstituted tobacco that is formed from a slurry including tobacco particles, fiber particles, aerosol formers, flavors, and binders. Tobacco particles may be of the form of a tobacco dust having a particle size preferably in the order between about 30-80 μm or about 100-250 μm, depending on the desired sheet thickness and casting gap. Fiber particles may include tobacco stem materials, stalks or other tobacco plant material, and other cellulose-based fibers, such as wood fibers having a low lignin content. Fiber particles may be selected based on the desire to produce a sufficient tensile strength for the cast leaf versus a low inclusion rate, for example, a rate between approximately 2 percent to 15 percent. Alternatively or additionally, fibers, such as vegetable fibers, may be used either with the above fibers or in the alternative, including hemp and bamboo.

Aerosol-forming substrates comprising gathered sheets of homogenised tobacco for use in aerosol-generating articles may be made by methods known in the art, for example the methods disclosed in the international patent application WO 2012/164009 A2.

Aerosol formers may be added to the slurry that forms the cast leaf tobacco. Functionally, the aerosol former should be capable of vaporizing within the temperature range at which the cast leaf tobacco is intended to be used in the tobacco product, and facilitates conveying nicotine or flavour or both nicotine and flavour, in an aerosol when the aerosol former is heated above its vaporization temperature. The aerosol former is preferably chosen based on its ability to remain chemically stable and essentially stationary in the cast leaf tobacco at or around room temperature, but which is able to vaporize at a higher temperature, for example, between 40 degree to 450 degree Celsius.

As used herein, the term aerosol refers to a colloid comprising solid or liquid particles and a gaseous phase. An aerosol may be a solid aerosol consisting of solid particles and a gaseous phase or a liquid aerosol consisting of liquid particles and a gaseous phase. An aerosol may comprise both solid and liquid particles in a gaseous phase. As used herein both gas and vapour are considered to be gaseous.

The aerosol aerosol-generating substrate may have an aerosol former content of between about 5 percent and about 30 percent on a dry weight basis. In a preferred embodiment, the aerosol-generating substrate has an aerosol former content of approximately 20 percent on a dry weight basis.

Preferably, the aerosol former is polar and is capable of functioning as a humectant, which can help maintain moisture within a desirable range in the cast leaf tobacco. Preferably, a humectant content in the cast leaf tobacco is in a range between 15 percent and 35 percent.

Aerosol formers may be selected from the polyols, glycol ethers, polyol ester, esters, fatty acids and monohydric alcohols, such as menthol and may comprise one or more of the following compounds: polyhydric alcohols, such as propylene glycol; glycerin, erythritol, 1,3-butylene glycol, tetraethylene glycol, triethylene glycol, triethyl citrate, propylene carbonate, ethyl laurate, triacetin, meso-erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

One or more aerosol former may be combined to take advantage of one or more properties of the combined aerosol formers. For example, triacetin may be combined with glycerin and water to take advantage of the triacetin's ability to convey active components and the humectant properties of the glycerin.

The length of an aerosol-forming substrate segment may be about 5 mm to about 16 mm, preferably between about 8 mm to about 14 mm, preferably between, for example 12 mm. Accordingly, a double-length aerosol-forming substrate preferably has a length of between about 16 mm and 32 mm, preferably 24 mm. An external diameter of an aerosol-forming substrate may be at least 5 mm and may be between about 5 mm and about 12 mm, for example between about 5 mm and about 10 mm or of between about 6 mm and about 8 mm. In a preferred embodiment, the aerosol-generating substrate has an external diameter of 7.2 mm plus-minus 10 percent.

Tobacco cast leaf is preferably crimped, gathered and/or folded to form a rod-shaped segment. The cast leaf material tends to be tacky and be plastically deformable. If pressure is exerted onto the cast leaf segment, the segment tends to irreversibly deviate from its intended, for example circular, shape.

An aerosol-cooling segment may be a component of an aerosol-generating article and is in the final product located downstream of the aerosol-forming substrate. In use, an aerosol formed by volatile compounds released from the aerosol-forming substrate passes through the aerosol-cooling segment. The aerosol is cooled therein before being through contact with the cooling material. An aerosol-cooling segment is preferably positioned between an aerosol-forming substrate and a mouthpiece. Preferably, an aerosol-cooling segment has a large surface area, but causes a low pressure drop. Filters and other mouthpieces that produce a high pressure drop, for example filters formed from bundles of fibers, are not considered to be aerosol-cooling segments. Chambers and cavities such as expansion chambers and support elements are also not considered to be aerosol-cooling segments. An aerosol-cooling segment preferably has a porosity in a longitudinal direction of greater than 50 percent. The airflow path through the aerosol-cooling element is preferably relatively uninhibited. An aerosol-cooling segment may be a gathered sheet or a crimped and gathered sheet. An aerosol-cooling segment may comprise a sheet material selected from the group consisting of polyethylene (PE), polypropylene (PP), polyvinylchloride (PVC), polyethylene terephthalate (PET), polylactic acid (PLA), cellulose acetate (CA), and aluminium foil or any combination thereof. An aerosol-cooling segment preferably comprises a sheet of PLA, more preferably a crimped, gathered sheet of PLA. An aerosol-cooling segment may be formed from a sheet having a thickness of between about 10 μm and about 250 μm, for example about 50 μm. An aerosol-cooling segment may be formed from a gathered sheet having a width of between about 150 mm and about 250 mm. An aerosol-cooling segment may have a specific surface area of between about 300 $mm^2$ per mm length and about 1000 $mm^2$ per mm length between about 10 $mm^2$ per mg and about 100 $mm^2$ per mg weight. In some embodiments, the aerosol-cooling element may be formed from a gathered sheet of material having a specific surface area of about 35 $mm^2$ per mg. An aerosol-cooling segment may have an external diameter of between about 5 mm and about 10 mm, for example about 7 mm. An aerosol-cooling segment in a single product, an aerosol-cooling plug, may have a length of between about 7 mm and about 28 mm, for example about 18 mm. Accordingly, a double-length aerosol-cooling segment preferably has a length of between about 14 mm and 56 mm, preferably 36 mm. An external diameter of an aerosol-cooling segment may be between about 5 mm and about 12 mm, for example 7 mm.

The compressibility of a segment can be measured in a compression test in which the segment is placed on a substantially flat support surface and a force is applied in a downwards direction on one side of the segment using a head having a flat, 12 mm round surface moving at a speed of 100 mm per minute. A suitable apparatus for conducting such a test is the FMT-310 Force Tester of Alluris GmbH. Prior to testing, the segment is conditioned for 24 hours at a temperature of 22 degree Celsius and a relative humidity of 55 percent before the compression test is carried out. The test is continued until the insert has been compressed 1.5 mm. The force (Newton) at this point is the compressibility. If the test is unable to continue to 1.5 mm compression, the force can be normalized to 1.5 mm. In other words, if the maximum compressive force is 28 Newton and the compression at this maximum compression is 1.4 mm, the reported value for compressibility will be 30 Newton per 1.5 mm (28 Newton divided by 1.4 multiplied by 1.5).

A segment of the stream of segments may be a mouthpiece. A mouthpiece is the last segment in the downstream direction of the aerosol-generating article or aerosol-generating device. The consumer contacts the mouthpiece in order to pass an aerosol generated by the aerosol-generating article or aerosol-generating device though the mouthpiece to the consumer. Thus, a mouthpiece is arranged downstream of an aerosol-forming substrate. A mouthpiece may comprise a filter. A filter may have low particulate filtration efficiency or very low particulate filtration efficiency. A filter may be located at the downstream end of the aerosol-generating article. A filter may be longitudinally spaced apart from the aerosol-forming substrate. A filter may be a cellulose acetate filter plug.

The mouthpiece may have an external diameter of between about 5 mm and about 10 mm, for example of between about 6 mm and about 8 mm. In a preferred embodiment, the mouthpiece has an external diameter of 7.2 mm plus or minus 10 percent. The mouthpiece may have a length of between about 5 mm and about 20 mm. preferably a length of between about 5 mm and about 14 mm. In a preferred embodiment, the mouthpiece has a length of approximately 7 mm.

The aerosol-generating substrate and any other segment upstream of the mouthpiece, such as a support element and an aerosol-cooling segment, are circumscribed by an outer wrapper. The outer wrapper may be formed from any suitable material or combination of materials. Preferably, the outer wrapper is a cigarette paper.

The single product may have a total length of between about 40 mm and about 50 mm, for example about 45 mm.

A segment of the stream of segments may also be a void or a cavity arranged between two consecutive segments. Therein, a void is the absence of material that forms a cavity when being wrapped with a piece of wrapping material. Cavities or voids may for example serve to help expand an aerosol in the aerosol-generating product or to adapt a length of an aerosol-generating article to a desired final length.

With a cavity or void this may be done without or without noticeably limiting a resistance to draw (RTD) of the aerosol-generating article.

In some embodiments, one of the at least three different segments is an aerosol-forming substrate.

In some embodiments, one of the at least three different segments is an aerosol-cooling segment.

In some embodiments, one of the at least three different segments is a support element.

In some embodiments, the additional segment is a mouthpiece, preferably comprising a filter.

In an aspect of the method according to the invention, two of the at least three different segments are double-length segments. Preferably, in the endless rod of segments, double-length segments are separated by at least one single-length segment. Such a separating single-length segment may for example be a support element.

In another aspect of the method according to the invention, the endless rod of segments comprises sequences of aerosol-forming substrate, support element and aerosol-cooling segment. Preferably, the aerosol-forming substrate is a tobacco containing substrate. Preferably, the support element is a hollow acetate tube and has the function of an expansion chamber for the aerosol generated in the aerosol-forming substrate. Preferably, the aerosol-cooling segment is made of a crimped or of a gathered or of a crimped and gathered polylactic acid sheet. In the sequences the support element is arranged between the aerosol-forming substrate and the aerosol-cooling segment. The sequences may be supplemented by further segments. Preferably, such further segments are also arranged between the aerosol-forming substrate and the aerosol-cooling segment.

According to a further aspect of the method according to the invention, the method further comprises the step of cooling at least one of the at least three different or the additional segment upon cutting the segment. Preferably, the cooling occurs during cutting or immediately after cutting the segment. Preferably, a polylactic acid containing segment is cooled. Cooling is especially favorable, if a material to be cut is sensitive in view of heat that may be generated upon cutting the material. An example for material used in segments for aerosol-generating articles may be a crimped sheet of polylactic acid. Polylactic acid has a low melting temperature. Cooling of the material of the segment may prevent inadvertent alteration of the material, for example a fusion of individual sheets or of areas within a sheet when a sheet is gathered in a rod. Cooling may be achieved by cooling a cutting blade or cooling objects the heat sensitive material comes into contact with. Cooling may, for example, be achieved by cooling a support the material is transported along. Additionally or alternatively, cooling may be achieved by providing a cooling gas flow directed to the material to be cooled.

According to another aspect of the invention, there is provided an apparatus for manufacturing aerosol-generating semi-finished products, wherein the semi-finished products are substantially cylindrical. The apparatus comprises a combiner for combining substantially cylindrical segments having a longitudinal axis in an end-to-end relationship along a longitudinal first motion path. The apparatus further comprises a tipping device for processing wrapped segment rods along a second motion path. The longitudinal axis of segments is arranged parallel to the first motion path and the longitudinal axis of segments in the wrapped segment rods are arranged perpendicular to a moving direction of the second motion path. The combiner comprises at least a first, a second and a third hopper for feeding a stream of at least first, second and third segments along the first motion path. The at least first, second and third segments are different segments, are arranged in an end-to-end relationship and are combined in an alternating order in the stream of at least first, second and third segments.

The combiner further comprises a wrapper for wrapping the stream of at least first, second and third segments in a sheet material to continuously form an endless rod of segments. The combiner also comprises a rod cutting device for cutting the endless rod of segments to separate the endless rod of segments into wrapped segment rods.

The tipping device comprises a fluted receiving drum for receiving wrapped segment rods in flutes of the fluted receiving drum. Therein an end of the first motion path extends into a longitudinal axis of the flutes of the fluted receiving drum. The tipping device also comprises a product cutting device for cutting the wrapped segment rod to divide the wrapped segment rod into two parts. The tipping device further comprises a separating device for separating the two parts of the cut wrapped segment rod along the longitudinal axis of segments of the cut wrapped segment rod. In the apparatus according to the invention, the product cutting device is arranged upstream of the separating device along the second motion path.

A transfer of the wrapped segment rods from the combiner into the fluted of the receiving drum of the tipping device may be performed by further moving the wrapped segment rods along the longitudinal motion path directly into flutes of a fluted receiving drum in the tipping device. Therein, a longitudinal axis of the flute is aligned with the longitudinal first motion path. However, a transfer from the combiner into flutes of a receiving drum may also be performed by a so called "spider mechanism". With the spider mechanism a wrapped segment rod is gripped by a spider arm from the combiner and is transferred into a flute of the receiving drum in the tipping device. Thereby, the spider arm performs a substantially elliptic or circular movement. However, the longitudinal axis of the wrapped segment rods remain arranged parallel to the longitudinal motion path and parallel to the longitudinal axis of the flutes. The realization of a spider mechanism is for example described for cigarettes in U.S. Pat. No. 5,327,803.

According to an aspect of the apparatus according to the invention, the tipping device further comprises a tipping hopper for feeding and inserting an additional segment in between the two parts of the cut and separated wrapped segment rod. The tipping device yet further comprises a rolling device for combining the two parts of the cut wrapped segment rod and the inserted additional segment by wrapping the two parts of the cut wrapped segment rod and the inserted additional segment in a tipping material to form a double product.

Preferably, the rod cutting device cuts the endless rod at a position of one of the at least first, second or third segments to divide the one of the at least first, second or third segments. Preferably, the rod cutting device cuts the wrapped segment rod at a position of a second one of the at least first, second or third segments to divide the second one of the at least first, second or third segments.

Preferably, at least one of the at least first, second and third segments, preferably two of the at least first, second and third segments are double-length segments having a length double than a length of a respective plug. Accordingly, the respective hopper or hoppers is or are adapted to receive and feed double-length segments.

Preferably, by the rod cutting device one double-length segment is cut into two segments of half-length forming two plugs corresponding to the respective segment in the final product.

In an aspect of the apparatus according to the invention, the apparatus further comprises cooling means for cooling at least one of the rod cutting device, the product cutting device and the final cutting device.

In another aspect of the apparatus according to the invention, the combiner further comprises a fourth hopper or potential further hoppers for feeding a fourth segment or further segments along the first motion path. Preferably, the fourth or further segment is a single-length segment. Depending on the amount of different segments an aerosol-generating product shall be combined from, a corresponding amount of hoppers may be provided. Typically, less hoppers than segments in an aerosol-generating product are provided.

According to another aspect according to the apparatus according to the invention, the tipping device further comprises a final cutting device for cutting the additional segment arranged in the double product to divide the additional segment to form single products.

Aspects and advantages of the apparatus have been described relating to the method according to the invention and will not be repeated here.

Preferably, the method and apparatus according to the invention as described herein are used in the production of aerosol-generating articles.

According to a further aspect of the invention, there is provided an aerosol-generating article, which is produced with the method as described herein.

The invention is further described with regard to an embodiment, which is illustrated by means of the following drawings, wherein FIG. 1 schematically shows a manufacturing process;

Figure 5:
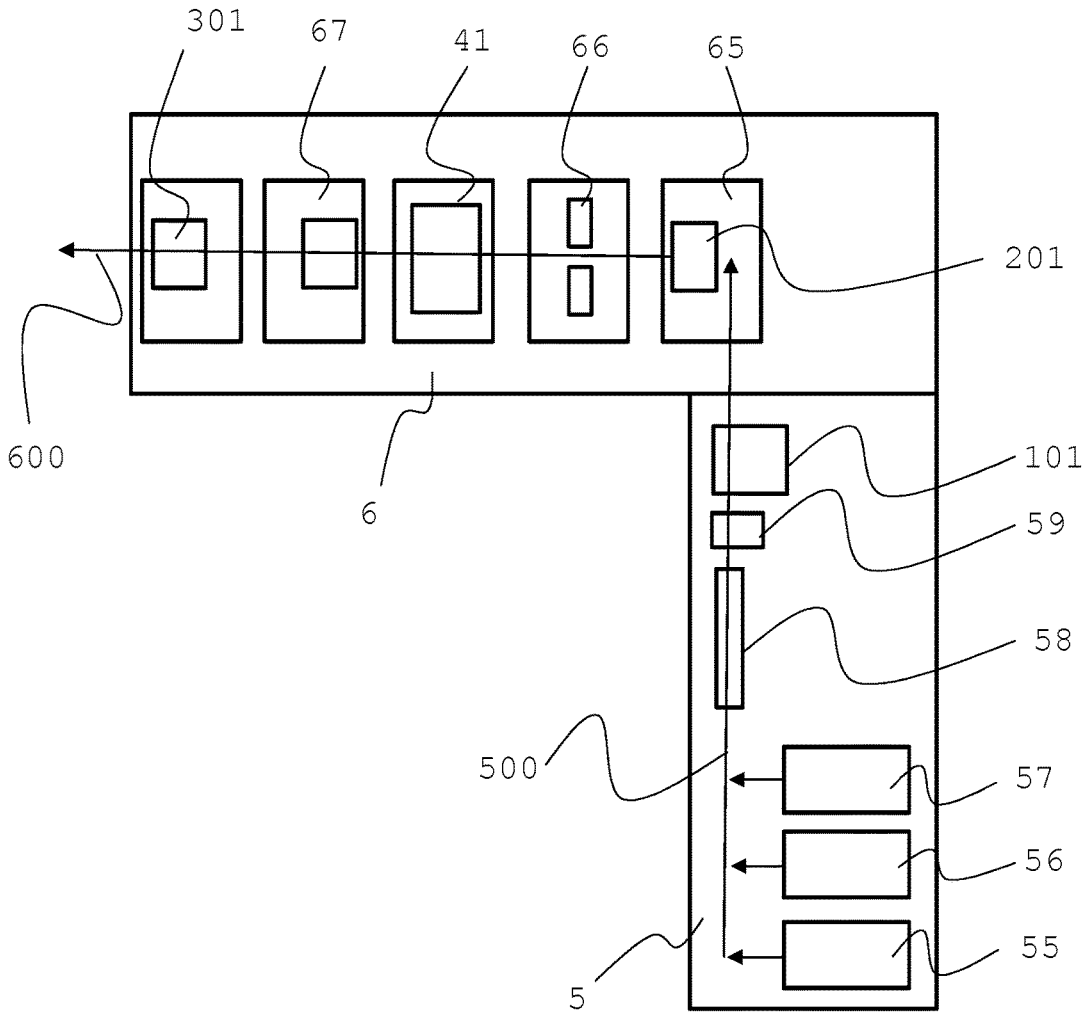

FIG. 5 schematically shows another embodiment of a manufacturing process.

Figure 1:
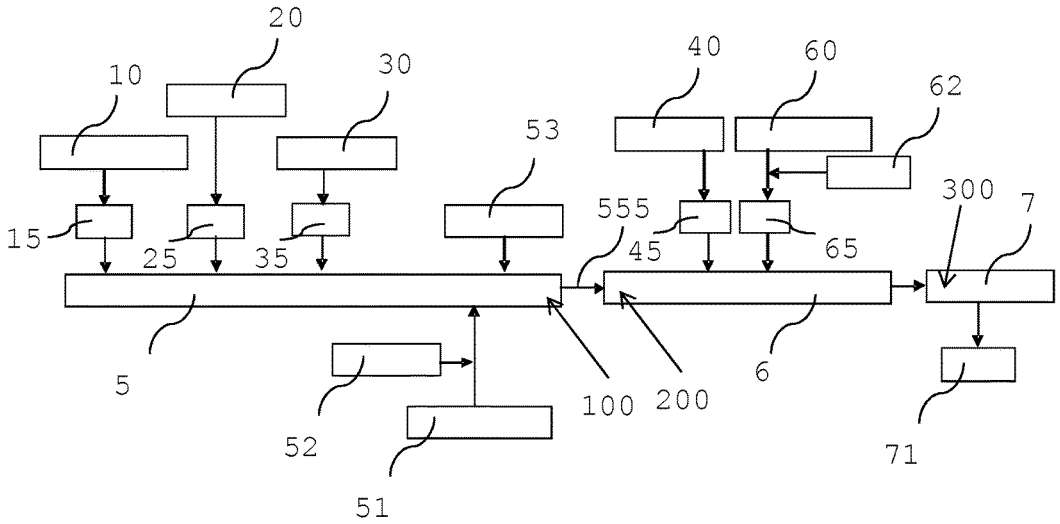

In FIG. 1 the process steps in the combiner 5 and in the adjacently arranged tipping device 6 are shown.

First rod 10, second rod 20 and third rod 30 of materials used in the manufacture of aerosol-generating articles are supplied and cut with respective cutting devices 15,25,35. The so cut first, second and third segments are supplied in an end-to-end relationship on a longitudinal motion path in the combiner 5.

Figure 2:
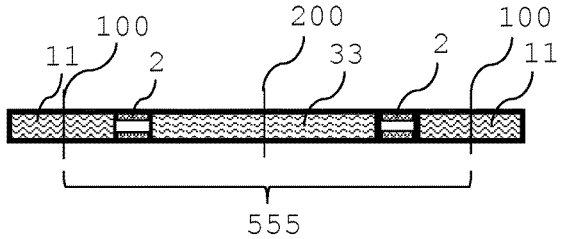
FIG. 2 shows a section of a rod of segments manufactured in a combiner.
Figure 3:
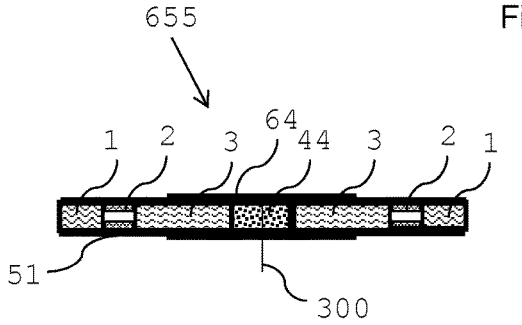
FIG. 3 shows a double product manufactured in the apparatus according to the invention.
Figure 4:
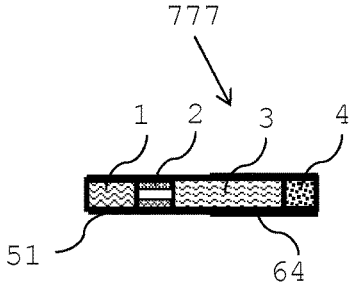
FIG. 4 shows the single product manufactured from the double product as shown in FIG. 4.

As shown in the embodiment shown in FIGS. 2 to 4, first and third rod 10, 30 are cut to double segments 11,33 having a length twice the length of the final plugs 1,3 before being fed to the longitudinal motion path in the combiner 5. Second rod 20 is cut to single segments 2 directly having the length of the plug 2 in the single product 777 before being fed to the longitudinal motion path.

The segments 11,2,33 form a stream of segments, wherein the segments are arranged in alternating manner such as 11,2,33,2,11,2,33,2,11 . . . . The axis of the segments are arranged parallel to the longitudinal motion path. A sheet of wrapping material 51, for example cigarette paper, is provided with an adhesive with glue provider 52. The sheet of wrapping material 51 is supplied to and guided along the longitudinal motion path in the combiner 5. The stream of segment is wrapped with the wrapping material 51, for example in a respective garniture provided along the longitudinal motion path. An additional glue provider 53 adds a seam of glue to the wrapping material 51 before the wrapping material is entirely wrapped around the stream of segments. The so formed rod of segments is now cut at the end of the longitudinal motion path in the combiner 5. Thereto, a rod cutting device is provided (not shown) that cuts the rod of segments by cutting the first segment 11 at cutting line 100 (see FIG. 2). The first segment 11 is cut in half such that the two cut parts of the first segments correspond to plugs 1. By this cutting of the endless rod of segments wrapped segment rods 555 are manufactured. Plugs 1 each form end segments of the wrapped segment rods 555. The wrapped segment rods 555 are now transferred from the longitudinal motion path in the combiner 5 to a perpendicular motion path in the tipping device 6.

This may be done by moving the wrapped segment rods further along the longitudinal motion path, for example with a linear movement, into flutes of a fluted receiving drum in the tipping device. Therein, a longitudinal axis of the flute is aligned with the longitudinal first motion path. A transfer from the combiner into flutes of a receiving drum may also be performed by a spider mechanism, for example, as described in U.S. Pat. No. 5,327,803 for cigarettes. A wrapped segment rod is then gripped by a spider arm from the combiner and transferred by the spider arm into a flute of the receiving drum in the tipping device. Since the axis of the segments substantially keep their orientation while being processed in the combiner and in the tipping device, the axis of the segments are parallel to the moving direction of the longitudinal motion path of the combiner 5 but perpendicular to the moving direction of the perpendicular motion path of the tipping device 6. Preferably, the tipping device 6 is arranged perpendicular to the combiner 5 such that the respective motion paths are also perpendicular to each other. By this, the axis of the segments are always oriented in a same direction. Such an embodiment is shown in more detail in FIG. 5 below.

In the tipping device 6 the wrapped segment rods 555 are divided by cutting the second segment 33 at cutting line 200. Thereby, the second segment 33 is cut in half such that the two cut parts of the segments correspond to plugs 3. The so cut wrapped segment rod 555 is separated by a separating device (not shown) along the longitudinal axis of the wrapped segment rod 555. In the space between to so cut and separated wrapped segment rod 555 a fourth segment 44 is inserted. The fourth segment is also a double length segment and is cut in a respective cutting device 45 from a fourth rod 40 supplied to the tipping device 6. A continuous sheet of tipping paper is provided and cut in cutting device 65 to individual tipping paper pieces 64. The piece of tipping paper 64 is wrapped around the fourth segment 44 as well as around portions of the two parts of the cut wrapped segment rod 555. Thus, these elements are combined with each other forming a double product 666 as shown in FIG. 3.

In an additional manufacturing process step 7, the double product 666 is cut in half by cutting the fourth segment 44 at cutting line 300. By this, two single and final products 777 as shown in FIG. 4 are manufactured. Every other single product is then turned such that all products have a same orientation. The so aligned and oriented products are transported to a packer 71 for packing the products, for example directly into smoking article packs or onto trays for storage and future packaging.

In FIG. 5 a manufacturing process for single products is shown in an arrangement of combiner 5 and tipping device 6, where combiner 5 and tipping device 6 are arranged adjacent and perpendicular to each other. The straight longitudinal motion path 500 in the combiner 5 and the perpendicular motion path 600 in the tipping device are also arranged perpendicular to each other. The perpendicular motion path 600 starts where the longitudinal motion path 500 ends.

The combiner 5 comprises three hoppers 55,56,57 for feeding three different segments in alternating manner to the longitudinal motion path 500 to form a stream of segments. The stream of segments is then wrapped in the wrapper 58 forming an endless rod of segments. The endless rod of segments is controlled in controller 59 and then cut into wrapped segment rods by rod cutting device 101. Preferably, the rod cutting device 101 is a rotating knife arranged next to the longitudinal motion path 500. The controller 59 may be provided for controlling a position of the segments in the endless rod of segments. For example to determine an exact position where the rod has to be cut, for example to secure that the rod is cut exactly between segments or at a position dividing a segment into smaller segments. The wrapped segment rods are then transferred each into a flute of a fluted receiving drum 65 of the tipping device 6. The longitudinal motion path 500 is a substantially straight path, where the segments or the stream of segments, respectively, are guided along in a substantially straight line. The first motion path 500 extends into the fluted receiving drum 65 of the tipping device. Preferably, the longitudinal motion path is arranged parallel to and in line with a flute of the fluted receiving drum 65, such that a wrapped segment rod cut by rod cutting device 101 may be transferred with a continuing straight movement into a flute of the fluted receiving drum longitudinally along the longitudinal motion path.

The wrapped segment rod is then cut on the fluted receiving drum 65 by product cutting device 201, for example comprising a rotating knife. The two parts of the cut wrapped segment rod are then separated while being arranged in flutes of separating drum 66. Hopper 41 inserts an additional segment, preferably a segment different to the segments of the endless rod of segments, in between the two parts of the cut wrapped segment rod. Preferably, the additional segment is a double-length mouthpiece. The two parts of the cut wrapped segment rod and the inserted additional segment are tipped on tipper 67 with a tipping material, for example a piece of paper. The so combined segments form a double product. In a final cutting device 301, the double product is cut into two single products.

Exemplary data for the process and product as described in FIGS. 1 to 4 are:

Tobacco rod 10 having a length of 120 mm is cut into double segments 11 of 24 mm length. The double length segments 11 are then cut into final plugs 1 of 12 mm length.

Hollow acetate tube rod 20 having a length of 96 mm is cut into plugs 2 of 8 mm length.

Rod 30 of gathered polylactic acid sheet having a length of 144 mm is cut into double segments 33 of 36 mm length. The double length segments 33 are then cut into final plugs 3 of 18 mm length.

Filter rod 40 is cut into double length segments 44 of 14 mm length. The double length segments 44 are then cut into final plugs 4 of 7 mm length.

The length of the wrapped segment rod 555 is 76 mm. The length of the double product 66 is 90 mm. The final product 77 has a length of 45 mm with a tolerance of less than plus or minus 1 mm, preferable less or equal to plus or minus 0.5 mm. The diameter of the final products is about 7.2 mm.

The final product is made of a series of tobacco plug 1, hollow acetate tube 2, plug of gathered polylactic acid (PLA) 3 and mouthpiece plug 4. A tipping paper 64 has a length of 20 mm and covers the entire length of the mouthpiece plug 4 and part of the PLA plug 3.

A production speed for the wrapped segment rod 555 may be about 5'000 per minute at a movement speed of the stream of segments along the longitudinal motion path of 380 meters per minute. A production speed of the double product 666 may also be about 5'000 per minute such that about 10'000 final products 777 may be produced per minute.

The invention claimed is:

1. Method for manufacturing aerosol-generating substantially cylindrical semi-finished products, the method comprising:

combining substantially cylindrical segments having a longitudinal axis in an end-to-end relationship along a longitudinal first motion path, thereby performing along the first motion path:

feeding a stream of at least three different segments along the first motion path, thereby arranging the at least three different segments in end-to-end relationship and in alternating order comprising a serial and inverse serial order, wherein one of the at least three different segments is an aerosol-forming substrate containing tobacco;

wrapping the stream of at least three different segments in a sheet material to form an endless rod of segments;

cutting the endless rod of segments, thereby separating the endless rod of segments into wrapped segment rods;

processing wrapped segment rods along a second motion path, thereby performing along the second motion path:

receiving the wrapped segment rods in flutes of a fluted receiving drum, wherein an end of the first motion path is aligned with a longitudinal axis of the flutes of the fluted receiving drum; wherein the longitudinal axis of segments in the endless rod of segments is arranged parallel to a moving direction of the first motion path and wherein the longitudinal axis of segments in the wrapped segment rods are arranged perpendicular to a moving direction of the second motion path;

cutting the wrapped segment rod thereby dividing the wrapped segment rod in two parts;

separating the two parts of the cut wrapped segment rod along the longitudinal axis of segments of the cut wrapped segment rod.

2. Method according to claim 1, further performing along the second motion path:

feeding and inserting an additional segment in between the two parts of the cut wrapped segment rod;

forming a double product by combining the two parts of the cut wrapped segment rod and the inserted additional segment by wrapping the two parts of the cut wrapped segment rod and the inserted additional segment in a tipping material.

3. Method according to claim 1, wherein cutting the endless rod of segments comprises cutting a first one of the at least three different segments.

4. Method according to claim 1, wherein cutting the wrapped segment rod comprises cutting a second one of the at least three different segments.

5. Method according to claim 1, wherein at least one segment is a rigid segment and at least one other segment is a compressible segment.

6. Method according to claim 2, further comprising the cutting the additional segment arranged in the double product, thereby dividing the additional segment and forming single products.

7. Method according to claim 1, wherein one of the at least three different segments is an aerosol-cooling segment.

8. Method according to claim 2, wherein the additional segment is a mouthpiece.

9. Method according to claim 1, wherein two of the at least three different segments are double-length segments.

10. Method according to claim 1, wherein the endless rod of segments comprises sequences of aerosol-forming substrate, support element and aerosol-cooling segment, wherein the support element is arranged between the aerosol-forming substrate and the aerosol-cooling segment.

11. Method according to claim 2, further comprising cooling at least one of the at least three different or the additional segment.

12. Apparatus for manufacturing aerosol-generating semi-finished products, wherein the semi-finished products are substantially cylindrical, the apparatus comprising:

a combiner for combining substantially cylindrical segments having a longitudinal axis in an end-to-end relationship along a longitudinal first motion path; and a tipping device for processing wrapped segment rods along a second motion path, wherein the longitudinal axis of segments is arranged parallel to the first motion path and wherein the longitudinal axis of segments in the wrapped segment rods are arranged perpendicular to a moving direction of the second motion path;

the combiner comprising:

at least a first, a second and a third combiner hopper arranged in sequence along the first motion path for feeding a stream of at least first, second and third segments along the first motion path, wherein one of the at least first, second and third segments is an aerosol-forming substrate comprising tobacco, wherein the at least first, second and third segments are different segments, are arranged in an end-to-end relationship and are combined in an alternating order comprising a serial and inverse serial order in the stream of at least first, second and third segments;

a wrapper arranged downstream of at least the first, the second, and the third combiner hopper and arranged along the first motion path, the wrapper for wrapping the stream of at least first, second and third segments in a sheet material to form an endless rod of segments;

a rod cutting device arranged downstream of the wrapper along the first motion path for cutting the endless rod of segments to separate the endless rod of segments into wrapped segment rods;

the tipping device comprising:

a fluted receiving drum for receiving wrapped segment rods in flutes of the fluted receiving drum, wherein an end of the first motion path extends into a longitudinal axis of the flutes of the fluted receiving drum;

a product cutting device for cutting the wrapped segment rod to divide the wrapped segment rod in two parts;

a separating device for separating the two parts of the cut wrapped segment rod along the longitudinal axis of segments of the cut wrapped segment rod, wherein the product cutting device is arranged upstream of the separating device.

13. Apparatus according to claim 12, wherein the tipping device further comprises:

a tipping hopper for feeding and inserting an additional segment in between the two parts of the cut wrapped segment rod;

a rolling device for combining the two parts of the cut wrapped segment rod and the inserted additional segment by wrapping the two parts of the cut wrapped segment rod and the inserted additional segment in a tipping material to form a double product.

14. Apparatus according to claim 13, wherein the tipping device further comprises a final cutting device for cutting the additional segment arranged in the double product to divide the additional segment to form single products.

15. Apparatus according to claim 12, wherein the combiner and the tipping device are arranged perpendicular to each other such that the second motion path is arranged perpendicular to the first motion path.

16. Apparatus according to claim 12, wherein the combiner further comprises a fourth hopper or further hopper for feeding a fourth segment or further segment, preferably a single-length segment, along the first motion path.

17. Apparatus according to claim 14, further comprising a cooling gas flow or a cooled cutting blade for cooling at least one of the rod cutting device, the product cutting device, and the final cutting device.

* * * * *